United States Patent [19]

Porter

[11] 3,949,529

[45] Apr. 13, 1976

[54] INSULATING STRUCTURAL ASSEMBLY AND STUD MEMBER FOR FORMING SAME

[75] Inventor: William H. Porter, Holland, Mich.

[73] Assignee: W. H. Porter, Inc., Holland, Mich.

[22] Filed: Jan. 29, 1975

[21] Appl. No.: 544,878

Related U.S. Application Data

[63] Continuation of Ser. No. 344,569, March 26, 1973, Pat. No. 3,881,290.

[52] U.S. Cl. ..... 52/281; 52/309; 52/727; 52/730

[51] Int. Cl.[2] ..... E04C 3/30

[58] Field of Search ..... 52/461, 727, 730, 404, 52/407, 309, 281, 267, 270, 464, 460, 466, 417, 418, 419, 420

[56] References Cited

UNITED STATES PATENTS

| | | | |
|---|---|---|---|
| 2,134,674 | 10/1938 | Sherman et al. | 52/730 X |
| 3,121,649 | 2/1964 | Oliver | 52/419 X |
| 3,362,120 | 1/1968 | Warren | 52/309 |

*Primary Examiner*—Ernest R. Purser
*Assistant Examiner*—Carl D. Friedman
*Attorney, Agent, or Firm*—Gordon W. Hueschen

[57] ABSTRACT

Insulating stud members comprising a foamed core having a sheet-form fastening member affixed to one surface and a thin moisture-impervious sheet affixed to the other surface and extending beyond the edges of the core to provide sealing flanges, and assemblies comprising a plurality of abutting insulating panels joined by the stud members, the panels each having a foamed core slab and a rigid facing sheet bonded to the core slab on one side thereof and a recess extending along the free edge of each of the adjacent core slabs, the recesses of adjacent panels cooperating to define a continuous open channel therebetween of dimensions just sufficient to receive a stud member so that the flanges thereof engage the surface of the insulating panels, fastening means extending through the insulating panels and having their ends embedded in the sheet-form fastening members of the stud members, and the sealing flanges being sealed to the surfaces of the insulating panels by means of a sealing material.

8 Claims, 4 Drawing Figures

INSULATING STRUCTURAL ASSEMBLY AND STUD MEMBER FOR FORMING SAME

This is a continuation of application Ser. No. 344,569, filed Mar. 26, 1973, now U.S. Pat. No. 3,881,290.

BACKGROUND OF THE INVENTION

The present invention relates to paneling for forming or lining insulated enclosures, and is more particularly concerned with such paneling containing foamed core slabs and being joined to adjacent panels by means of an insulating stud.

Insulated panels are frequently utilized to provide a lining for refrigerated enclosures such as food processing rooms, cold rooms, milking parlors, butcher shops, slaughterhouses, and the like. In order to minimize heat leakage into such refrigerated enclosures it is important to provide a substantially continuous thermal barrier throughout the insulating lining, particularly in places where two adjacent panels are joined together.

SUMMARY OF THE INVENTION

Accordingly, it is an object of the invention to provide an insulated panel assembly that has a vapor seal on the outside wall at the joint between the panels. It is still an additional object of the invention to provide a vapor seal joint which permits some error in installation and permits change in position of panels after installation due to thermal changes or mechanical forces without disturbing the vapor-proof seal at the joint. It is still another object of the invention to provide mechanical means of securing panels to a wall with nails or other metallic fasteners such as screws in such a way that the metallic fasteners do not provide a through continuous heat conductor. It is a further object of the invention to provide a structure which can withstand relative shift of adjacent panels due to differences in thermal expansion and/or differences in thermal gradients across individual panels without disrupting the seal between them and without causing other adverse conditions. It is yet another object of the invention to provide a structure wherein the joint between insulating panels is free of cracks or voids and is neat in appearance. It is still an additional object to provide a structure of the type described particularly adapted for joining interlocking panels of the type disclosed and claimed in copending application Ser. No. 159,295, filed July 2, 1971 for "Insulating Panel Construction," of the present inventor. Still other objects will readily present themselves to one skilled in the art upon reference to the ensuing specification, the drawings, and the claims.

The present invention contemplates in insulating panel assembly comprising abutting insulated panels, an elongated insulated connecting stud member, a flange means attached to the connecting stud member, and an attachment means securing the panels to the connecting stud member. The panels are made up of a foamed core slab of an insulating material and a rigid facing sheet bonded to one side of the core slab. Adjacent ends of the core slabs are each provided with a longitudinally extending recess along the free end edge of the core slab, and the recesses together define a continuous open channel therebetween. The connecting stud member is received in said channel and is complementary thereto, a flange means is attached to the connecting stud member, extends outwardly from an exposed side of the connecting stud member, and covers the juncture of the connecting stud member with the core slab.

DESCRIPTION OF THE PREFERRED EMBODIMENTS

Figure 1:
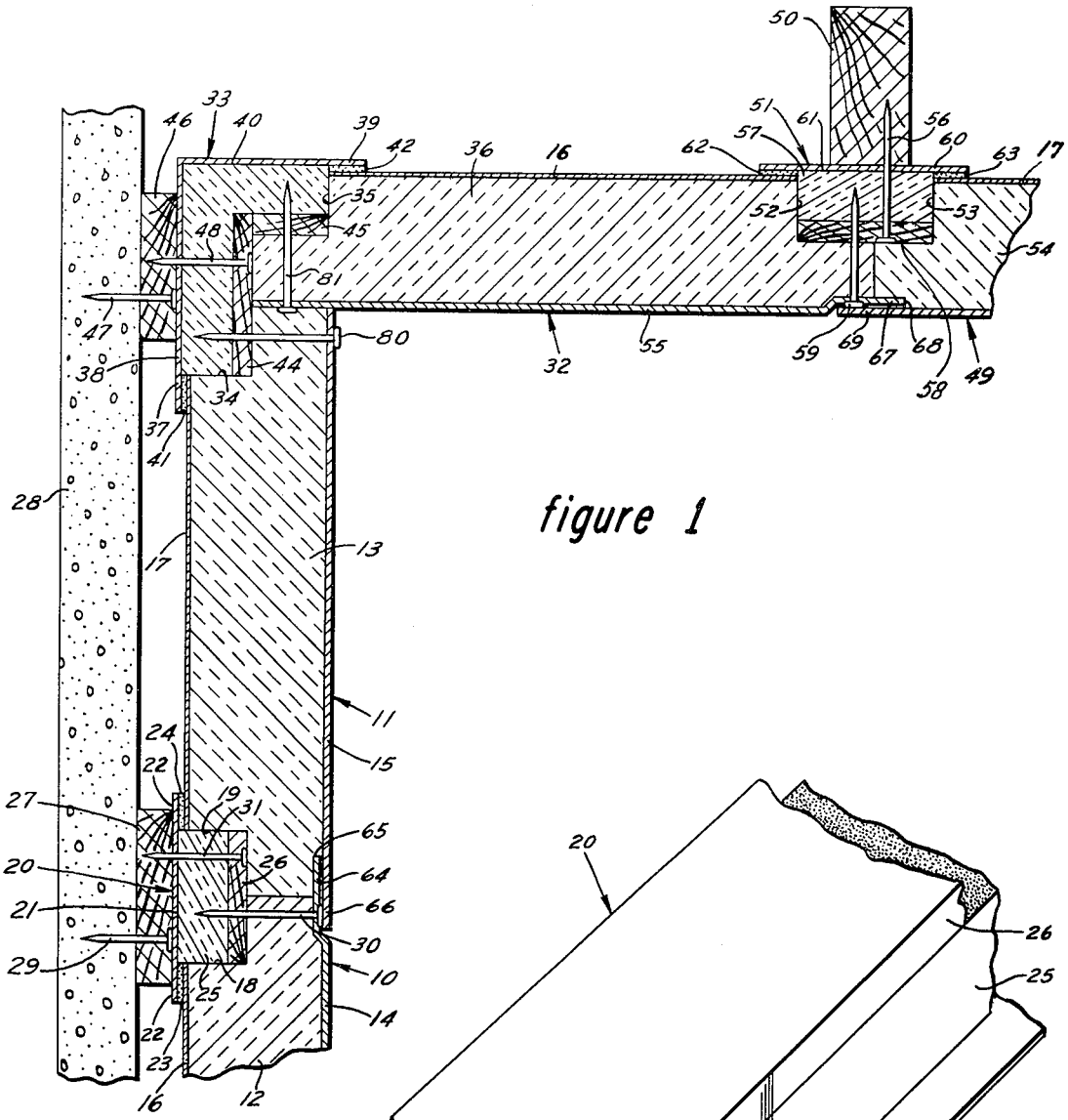
FIG. 1 is a sectional elevation showing a panel connection embodying the present invention.

Referring to FIG. 1, abutting insulating wall panels 10 and 11 each comprise respective foamed core slabs 12 and 13, as well as rigid facing sheets 14 and 15 bonded to core slabs 12 and 13 on one side thereof. Optional liners 16 and 17 made of a layer of heat-reflective material can also be bonded to core slabs 12 and 13 and serve to provide a further barrier to heat transmission.

Recess 18 is provided in core slab 12 at the end face thereof adjacent to abutting end face of core slab 13 and extends longitudinally along the free edge of the end face of core slab 12, i.e., the edge of the end face not bonded to facing sheet 14. Similarly, recess 19 is provided in core slab 13 extending longitudinally along the free edge of the abutting end face thereof and generally opposite to recess 18. Recesses 18 and 19 together define a continuous open channel therebetween and receive in the channel elongated, insulated connecting stud member 20 (FIGS. 1 and 2) which is complementary to the channel. Exposed side 21 of connecting stud member 20 is provided with a moisture-impervious sheet-form aluminum flange means such as cross-flange 22 adhesively attached thereto and extending outwardly from exposed side 21 so as to cover the junctures of connecting stud member 20 with core slabs 12 and 13. Resilient, non-hardening sealing compound 23 is placed between cross-flange 22 and core slab 12, to provide a vapor barrier seal which is maintained even if there is relative movement between panel 10 and connecting stud member 20 because of uneven thermal expansion or contraction due to differing coefficients of thermal expansion. Similarly, sealing compound 24 is provided between flange 22 and core slab 13.

Figure 2:
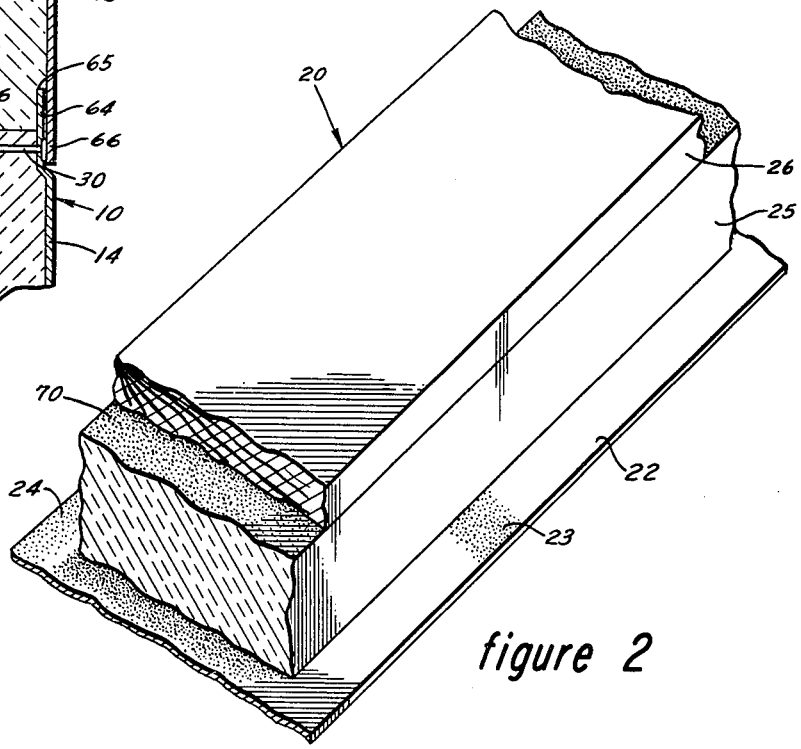
FIG. 2 is a fragmentary perspective view of a connecting stud member utilized in the panel connection of this invention.

Connecting stud member 20, as shown in detail in FIG. 2, preferably is a laminated structure comprised of a foamed slab 25 and a fastening member 26 such as a wood strip affixed thereto by means of an adhesive 70. In the embodiment shown in FIG. 2 wood strip 26 provides a convenient facing that can be used as a fastening member or nailer means for securing panels 10 and 11 to connecting stud member 20 with nail 30 and also for securing connecting stud member 20 by means of nail 31 to furring strip 27 attached to existing building wall 28 with appropriate fasteners such as nail 29. Instead of wood the nailer means 26 may be made of resin and fiberglass. Alternatively, connecting stud member 20 can be a laminate with the nailer means sandwiched between cross-flange 22 and foam slab 25, or a laminate with a plurality of alternating strips of wood or the like and rigid foam strips situated normal to cross-flange 22. However, for an optimum thermal barrier and for convenience of construction, the connecting stud member construction shown in FIG. 2 is preferred.

Figure 4:
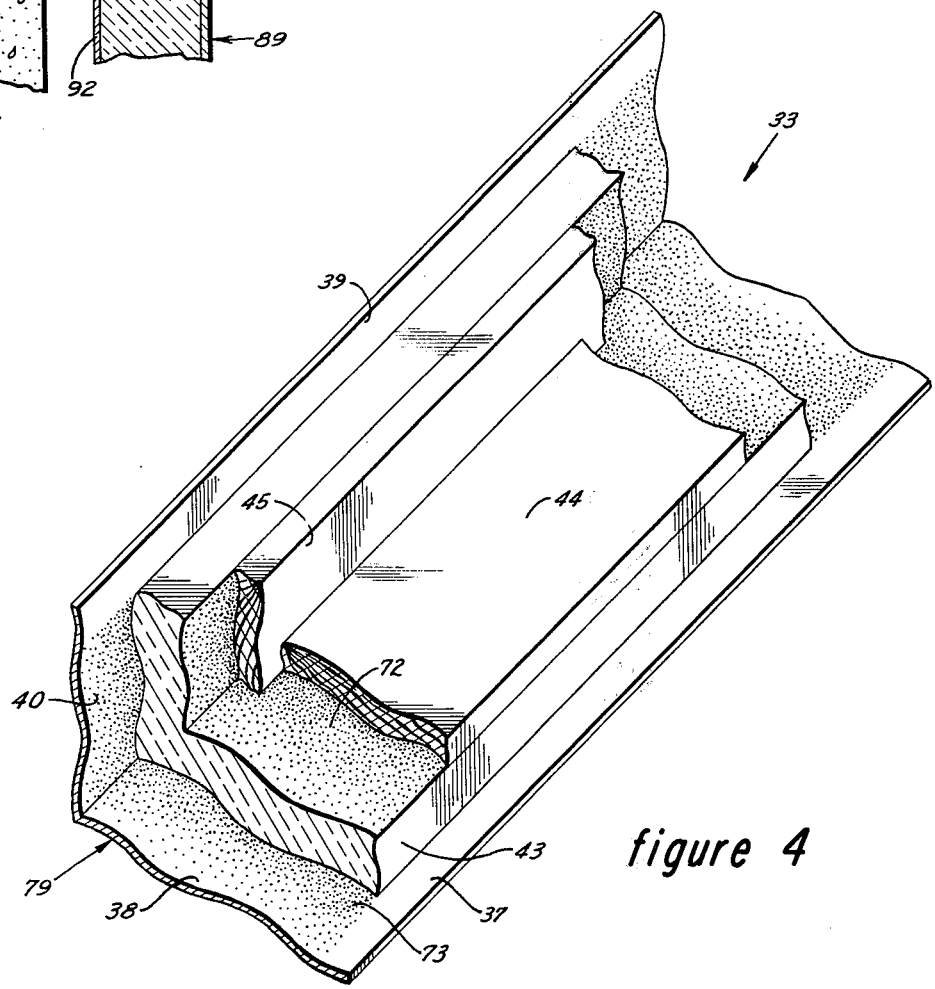
FIG. 4 is a fragmentary perspective view of a connecting stud member utilized in connecting corner panel assemblies.

As shown in detail in FIG. 4, an L-shaped connecting stud member 33 is provided for making wall-to-ceiling or wall-to-wall joints. The stud member 33 comprises a foamed core slab 43 having an attaching member or nailing means formed of wood strips 44 and 45 attached to inner surfaces of the foamed slab 43 by an adhesive 72. An outer moisture-impermeable sheet-form member 79 of a material such as sheet-form aluminum is affixed to the outer surface of the slab 43 by means of an adhesive 73. The sheet-form member 79 has two legs 38 and 40 disposed perpendicularly to each other, and extending beyond the edges of the slab 43 to provide sealing flanges 37 and 39.

A ceiling-to-wall connection is shown in FIG. 1 where panels 11 and 32 abut at substantially right angles, connecting stud member 33 is substantially L-shaped and is received in recess 34 of core slab 13 and recess 35 of core slab 36, which recesses together form a continuous open channel. Flange 37 covers the juncture of core slab 13 with connecting stud member 33. Flange 39 covers the juncture of core slab 36 with connecting stud member 33. Sealing compounds 41 and 42 provide a vapor barrier seal between flange 37 and panel 11 and between flange 39 and panel 32. Furring strip 46 is attached to wall 28 by nail 47, and connecting stud member 33 is, in turn, attached to furring strip 46 by nail 48. Panels 11 and 32 are attached to connecting stud member 33 by means of nails 80 and 81.

Panels 32 and 49 are substantially similar to panels 10 and 11 and comprise foamed core slabs 36 and 54, respectively, faced with respective rigid facing sheets 55 and 49 bonded to one side of the core slabs. Connecting stud member 51 is attached by nail 56 passing therethrough to ceiling beam 50 and comprises foam slab 57 and facing 58 which can be made of wood, plastic, metal, or the like material. An open, continuous channel is defined between panels 32 and 49 by respective recesses 52 and 53 situated generally opposite each other and extending along the free edge of abutting end faces of core slabs 36 and 54. Connecting stud member 51 is complementary to the defined channel and is secured to panels 32 and 49 by means of nail 59 which passes through facing sheet 55 and is anchored in facing 58. Cross-flange 60 is attached to exposed side 61 of connecting stud member 51 and extends outwardly so as to cover the juncture of panel 32 with connecting stud member 51 and the juncture of panel 49 with connecting stud member 51. A vapor barrier seal is provided by resilient sealing compounds 62 and 63 that permit relative movement, between panels 32 and 49 on one hand and connecting stud member 51 on the other, brought about by differences in thermal expansion.

If desired, core slabs 36 and 54 can be lined with heat-reflective material such as liners 16 and 17.

While each insulated panel can be secured individually to a complementary connecting stud member received in the channel between two abutting panels either by gluing or by appropriate fasteners, in order to decrease potential path of heat transfer it is desirable to minimize the number of through fasteners that are employed. To this end, facing sheets can be designed to be interlocking by overlapping a portion of the facing sheet over the underlying foamed core slab, debossing one of two adjacent overlapping portions and providing a slot under the other, planar overlapping portion within which the debossed portion is received. Then, by passing a fastener through the debossed portion of a facing sheet of one of two adjacent panels, both panels are secured to the connecting stud member, and the fastener is covered by the overlapping planar portion of the other adjacent panel.

Such an arrangement is illustrated in FIG. 1 where debossed flange member 64 of facing sheet 14 is received in slot 65 provided in opposing end face of core slab 13 and underlying planar flange member 66 of facing sheet 15 which overlaps the end face of core slab 13. Similarly, debossed flange member 67 of facing sheet 55 is received in slot 68 provided in opposing end face of core slab 54 and underlying planar flange member 69 which overlaps the end face of core slab 54. Such structures are disclosed and claimed in copending application Ser. No. 159,295, referred to above.

Figure 3:
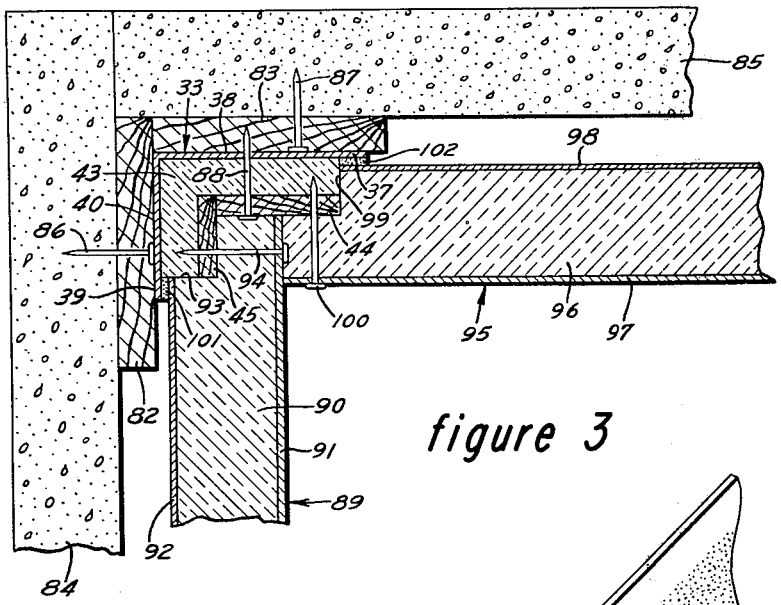
FIG. 3 is a sectional top view showing corner panel connections embodying the present invention for wall-to-wall joints.

Referring to FIG. 3, a corner wall panel-to-wall panel joint is shown utilizing structures similar to those of FIG. 1. Furring strips 82 and 83 are shown attached to conventional building wall structures 84 and 85 by means of nails 86 and 87, respectively. A corner stud 33 as shown in FIG. 4 is affixed to the furring strip 83 by means of a nail 88. If desired, the stud 33 may also be affixed to the furring strip 82 by a nail in similar manner. An insulating panel 89 comprising a foamed core 90, a rigid facing sheet 91 and a heat-reflective liner 92 forms one side of the joint structure. A recess 93 is provided for receiving one leg of the stud member 33. The panel 89 is affixed to the stud member 33 by means of a nail 94. Additionally, a field adhesive such as a contact adhesive may be utilized to seal the engaging surfaces of the insulating panel with the surfaces of the stud member 33. A second insulating panel 95 comprising a foamed core 96, a rigid facing sheet 97, a heat reflective liner 98 and a recess 99 is affixed to the stud 33 by means of a nail 100 passing through the panel and embedded in the wood strip 44. A contact adhesive may also be used to seal the panel edges to the stud member 33. An adhesive 101 and 102, preferably an elastomeric or non-solidifying adhesive, is provided intermediate the flanges 37 and 39 and the inner surfaces of the panels 95 and 89. The mechanics of construction of the wall-to-wall joint is similar to that of constructing a wall-to-ceiling joint as described above.

The foamed core slab of the insulated panels and the foam slab of the connecting stud member is preferably made of a halogenated hydrocarbon-blown rigid polyurethane foam which provides a K-factor of about 0.15 upon aging. However, the particular type of material that can be used is chiefly determined by the desired insulating properties of the panel. Other suitable materials are closed-cell foamed polystyrene (K-factor equals 0.20), foam rubber, ceramic foam, and the like.

The rigid facing sheets preferably are fiberglass-reinforced polyester resin sheets; however, any other type of plastic sheet material, or the like, capable of withstanding the contemplated use are suitable. Other typical materials are vinyl sheets, fiberglass-reinforced vinyl sheets, and the like.

A preferred heat-reflective material for the back side of the foamed core slab is aluminum foil. If the core slab is foamed with an integral skin, the skin itself can be painted with an aluminum paint, or the like.

A suitable resilient, non-hardening sealing compound for sealing the stud member flanges to the panels is a silicone rubber caulking compound, or the like. If desired, the sealing compound can also be used to fill the seams at the juncture of the overlapping flanges of adjacent panels.

The foamed cores of the stud members may be of material similar to that of the panels.

The fastening member or nailer layer may be of any relatively hard material which will accept screws or nails. Wood is preferred, although fiberglass-supported resin sheets may be utilized.

The facing materials may be of any material such as sheet metal or plastic material. However, sheet aluminum is preferred. Screws may be used as well as nails, and even non-metallic fastening means may be used if it is of suitable strength.

If desired a field adhesive may be used intermediate the various joint surfaces to render the structures moisture-impervious.

The insulating panel and stud member assemblies of the present invention have many advantages over the prior art structures. Because a separate stud member is utilized, which may be independently fastened to a furring strip or other support, a separate fastening means such as a nail or a screw may be utilized to support the panel members to the stud member. This results in a cascade arrangement of nails or screws so that there is no single continuous metallic path which would cause a heat conduction loss from one surface of the structure to the other. A further advantage lies in the fact that a metallic flange extends on the inner sides of the stud member and forms a seal with the engaging surface of the panels oriented in the direction of movement of the panels caused by heat expansion or contraction. When the panel members expand or contract, it is in the direction of the seal and even though the edge of a panel may slide with respect to the flange, because the flange is sufficiently large and because a soft elastomeric sealing material is used, a continuous and unbroken seal remains. In prior art structures panels are sealed at a butt joint wherein the plane of the movement of the panels is perpendicular to the seal. This causes the seal to be broken by only a relatively small movement due to heat expansion or contraction. A further advantage is that the stud members are particularly adapted for use with interlocking panels as described above. Additionally, the corner-type of stud member may be utilized to connect adjacent panels either at a vertical corner or at a juncture with panels used at the ceiling. The metallic flanges may lap endwise as well as sidewise to provide seals with structures at the end of the studs.

Another advantage is that when used with interlocking panels as shown and described, a continuous strong surface is provided without exposed fasteners.

The foregoing discussion and the drawings are illustrative of the present invention and are not to be taken as limiting. Still other variations within the spirit and scope of the invention will readily present themselves to the skilled artisan.

I claim:

1. An insulating stud assembly comprising a stud member adapted to join a pair of abutting insulating panels each having undercut edges which, when the panels are abutted, form a complementary panel to receive said stud member and a sheetform moisture-impervious layer affixed to one surface of said stud member having margins extending beyond the edges of said stud member adapted to underlie said panels and to provide sealing flanges for holding a sealing material in contact with said panels, said stud member comprising an insulating slab layer laminated to a fastening means layer of a material substantially harder than said slab layer adapted to receive elongated metal fastening means and to hold the same tightly.

2. An insulating stud assembly according to claim 1, wherein said sheet-forming member is of aluminum and said fastening means layer is of wood.

3. An insulating stud assembly according to claim 1, in which the stud member has an L-shaped cross-section and is adapted to join a pair of insulating panels perpendicularly disposed with respect to each other, one leg of the L having a length equal to the undercut portion of one panel and the other leg of the L having a length equal to the thickness of the said one panel at the undercut, plus the length of the undercut portion of the complementary panel.

4. An insulating stud assembly according to claim 3, wherein said sheet-form moisture-impervious layer also has an L-shaped cross-section and is formed of aluminum and said fastening means is formed of wood.

5. An insulating stud assembly according to claim 1, wherein said slab layer is of a rigid foam plastic material.

6. The insulating stud assembly according to claim 5, in which the plastic material is halogenated hydrocarbon-blown polyurethane having a K factor of about 0.15.

7. The insulating stud assembly according to claim 1, in which sealing flanges carry a layer of resilient, non-hardening sealing compound.

8. The insulating stud assembly according to claim 7, in which the sealing compound is a silicone rubber caulking compound.

* * * * *

UNITED STATES PATENT OFFICE

CERTIFICATE OF CORRECTION

Patent No. 3,949,529 Dated April 13, 1976

Inventor(s) William H. Porter

It is certified that error appears in the above-identified patent and that said Letters Patent are hereby corrected as shown below:

[63] Pat. No. 3,881,290 -- should read --

Pat. No. 3,881,292.

Col. 1, line 7: Pat. No. 3,881,290 -- should read --

Pat. No. 3,881,292.

Signed and Sealed this

Nineteenth Day of October 1976

[SEAL]

*Attest:*

RUTH C. MASON
*Attesting Officer*

C. MARSHALL DANN
*Commissioner of Patents and Trademarks*